US008761629B2

(12) United States Patent
Okumura

(10) Patent No.: US 8,761,629 B2
(45) Date of Patent: Jun. 24, 2014

(54) POWER SUPPLY CIRCUIT FOR SUPPLYING POWER TO ELECTRONIC DEVICE SUCH AS IMAGE FORMING APPARATUS

(75) Inventor: Yasuhiko Okumura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 277 days.

(21) Appl. No.: 13/217,782

(22) Filed: Aug. 25, 2011

(65) Prior Publication Data

US 2012/0070177 A1 Mar. 22, 2012

(30) Foreign Application Priority Data

Sep. 22, 2010 (JP) ..... 2010-212706

(51) Int. Cl.
*G03G 15/00* (2006.01)

(52) U.S. Cl.
USPC ..... 399/88; 399/53; 399/55; 399/235; 399/270

(58) Field of Classification Search
USPC ..... 399/53, 88, 55, 235, 240, 270
See application file for complete search history.

(56) References Cited

U.S. PATENT DOCUMENTS

| | | | |
|---|---|---|---|
| 4,947,312 | A | 8/1990 | Tsuruoka et al. |
| 5,663,744 | A | 9/1997 | Seike et al. |
| 7,791,908 | B2 | 9/2010 | Na et al. |
| 8,135,295 | B2 | 3/2012 | Hamada |
| 8,213,823 | B2 | 7/2012 | Yamamoto |
| 8,265,511 | B2 | 9/2012 | Kosaka et al. |
| 8,311,429 | B2 | 11/2012 | Okumura |
| 8,437,652 | B2 | 5/2013 | Nagasaki |
| 2008/0055296 | A1 | 3/2008 | Miyazawa |
| 2009/0028593 | A1 * | 1/2009 | Okumura ..... 399/55 |
| 2010/0209132 | A1 | 8/2010 | Takami |
| 2012/0070177 | A1 | 3/2012 | Okumura |

FOREIGN PATENT DOCUMENTS

| | | | |
|---|---|---|---|
| CN | 1159599 | A | 9/1997 |
| CN | 101141841 | A | 3/2008 |
| CN | 201248085 | Y | 5/2009 |
| CN | 101771352 | A | 7/2010 |
| JP | 61-173670 | A | 8/1986 |
| JP | 10-313573 | A | 11/1998 |
| JP | 2002-354831 | A | 12/2002 |

OTHER PUBLICATIONS

U.S. Appl. No. 13/218,325, filed Aug. 25, 2011. Applicant: Yasuhiko Okumura.

* cited by examiner

*Primary Examiner* — Walter L Lindsay, Jr.
*Assistant Examiner* — Roy Y Yi
(74) *Attorney, Agent, or Firm* — Fitzpatrick, Cella, Harper & Scinto

(57) ABSTRACT

A developing unit develops a latent image with a developing agent. A supply unit supplies, to the developing unit, a developing alternating current bias voltage with a waveform having a pulse period during which a rectangular wave is output and a blank period during which no rectangular wave is output. An input signal generation unit generates, as an input signal be supplied to a primary side of a transforming unit that forms the developing alternating current bias voltage, an input signal obtained by adding an additional pulse smaller in width than the rectangular wave in the pulse period at a timing to transit from the pulse period to the blank period.

13 Claims, 8 Drawing Sheets

POWER SUPPLY CIRCUIT FOR SUPPLYING POWER TO ELECTRONIC DEVICE SUCH AS IMAGE FORMING APPARATUS

BACKGROUND OF THE INVENTION

1. Field of the Invention

The present invention relates to a power supply circuit for supplying power to an electronic device such as an image forming apparatus.

2. Description of the Related Art

A developing device in an electrophotographic or electrostatic printing image forming apparatus efficiently develops an electrostatic latent image with toner by applying, to a developing sleeve, a voltage in which DC (Direct Current) and AC (Alternating Current) voltages are superposed. In particular, an AC voltage having a rectangular waveform increases the charging efficiency of toner with respect to a latent image (ratio at which toner charges couple with latent image charges).

A voltage applied to the developing sleeve needs to have a target value. This is because various problems arise if an applied voltage greatly exceeds a target voltage to generate an overshoot. For example, a current flows through an unintended conductor via the surface of an insulator or an air layer. Also, aerial discharge occurs in a conductive impurity mixed in a developing agent, damaging a latent image. As one solution to relieve these problems, a damping resistor having a sufficiently large resistance value is adopted.

However, the use of the damping resistor also has disadvantages. For example, the rise and fall responses become slower than those of an ideal rectangular wave, resulting in a blunt rectangular wave. The blunt rectangular wave is poorer in charging efficiency than the ideal rectangular wave. The power loss across the damping resistor accounts for half the input power to an AC voltage generation circuit, increasing the space for permitting the energy loss and raising the component cost.

In Japanese Patent Laid-Open No. 2002-354831, an AC voltage generation circuit is formed from a full bridge circuit made up of four switching elements. A predetermined OFF period is set in part of a period during which each switching element is turned on. This arrangement relieves an overshoot without depending on a damping resistor.

The invention disclosed in Japanese Patent Laid-Open No. 2002-354831 can correct an output waveform distortion by LC resonance satisfactorily for a developing unit, photosensitive member, developing high-voltage power supply, and developing agent under a given condition. However, a problem arises when the conventional technique is applied to a so-called blank pulse waveform having a pulse period during which a rectangular wave is output and a blank period during which output of a rectangular wave stops.

FIG. 8 exemplifies a waveform when the conventional technique is applied to the blank pulse waveform. When a constant OFF period is always used, like the conventional technique, LC resonant waveforms appear at a leading edge from the blank period to the pulse period and a trailing edge from the pulse period to the blank period. Such a waveform distortion degrades the developing quality, as described above.

SUMMARY OF THE INVENTION

It is a feature of the present invention to achieve stable development while decreasing dependence on a damping resistor by suppressing a shape distortion of a blank pulse waveform.

The present invention provides an image forming apparatus comprising the following elements. A developing unit develops a latent image with a developing agent. A supply unit supplies, to the developing unit, a developing alternating current bias voltage with a waveform having a pulse period during which a rectangular wave is output and a blank period during which no rectangular wave is output. An input signal generation unit generates, as an input signal be supplied to a primary side of a transforming unit that forms the developing alternating current bias voltage, an input signal obtained by adding an additional pulse smaller in width than the rectangular wave in the pulse period at a timing to transit from the pulse period to the blank period.

Further features of the present invention will become apparent from the following description of exemplary embodiments (with reference to the attached drawings).

DESCRIPTION OF THE EMBODIMENTS

First Embodiment

Figure 1:
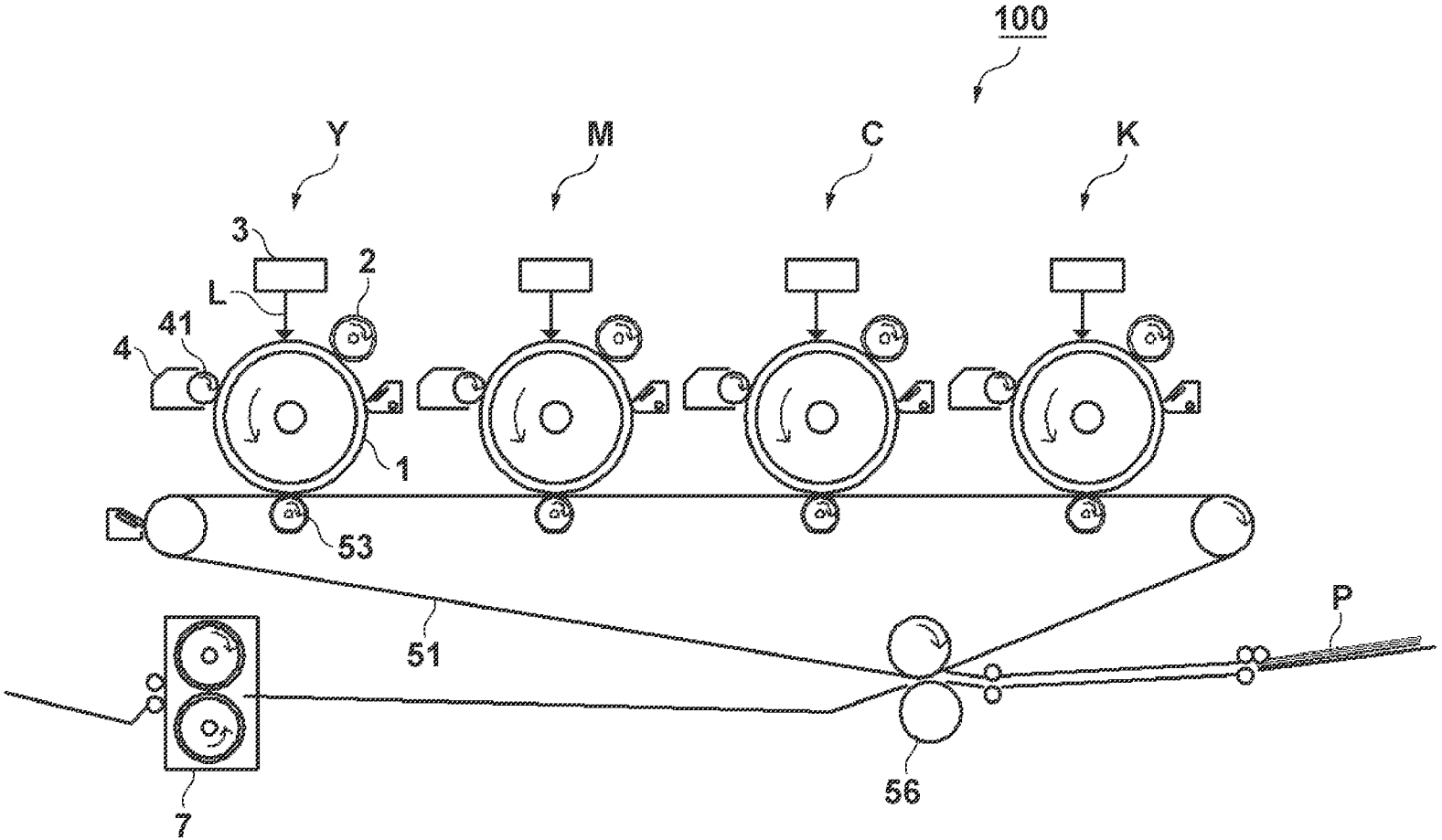
FIG. 1 is a schematic sectional view showing an image forming apparatus.

An image forming apparatus 100 shown in FIG. 1 is an electrophotographic multi-color image forming apparatus including a power supply circuit according to the present invention. Note that the present invention is applicable to even a monochrome image forming apparatus. The image forming apparatus 100 includes four image forming stations Y, M, C, and K which form images with developing agents (toners) of different colors, that is, yellow, magenta, cyan, and black. The image forming stations have basically the same arrangement, and the yellow image forming station will be explained as a representative.

When a host controller (not shown in FIG. 2) which controls the overall image forming apparatus 100 receives an instruction to form an image on a printing medium P, a photosensitive member 1, intermediate transfer belt 51, charging roller 2, developing sleeve 41, primary transfer roller 53, secondary transfer roller pair 56, and fixing unit 7 start rotating. A DC voltage or a high voltage obtained by superposing a sinusoidal voltage on a DC voltage is applied from a high-voltage power supply (not shown) to the charging roller 2.

The surface of the photosensitive member 1 in contact with the charging roller 2 is charged to the same potential as the DC voltage uniformly applied from the high-voltage power supply. Then, the surface of the photosensitive member 1 rotates to move to the position of laser irradiation from an exposure device 3. The exposure device 3 emits light L corresponding to an image signal, forming an electrostatic latent image. A power supply device 200 shown in FIG. 2 applies, to the developing sleeve 41 of a developing unit 4, a high voltage (developing bias) obtained by superposing an AC voltage (voltage of a rectangular wave) on a DC voltage. The developing bias generates negative charges in toner. The toner develops a positive-potential latent image from the developing sleeve 41, forming a toner image. The developing sleeve 41 is an example of a developing member to which a voltage supplied from the power supply device is applied. The photosensitive member 1 is an example of an image carrier which bears an electrostatic latent image that is developed with a developing agent supplied from the developing member. The toner image on the surface of the photosensitive member 1 moves and reaches the primary transfer roller 53 as the photosensitive member 1 rotates. Then, the toner image is transferred onto the intermediate transfer belt 51. Note that Y, M, C, and K toner images are registered and transferred onto the intermediate transfer belt 51. Finally, toner images of multiple colors are superposed and formed on the intermediate transfer belt 51. The intermediate transfer belt 51 is another example of the image carrier. The multi-color toner image on the surface of the intermediate transfer belt 51 moves and reaches the secondary transfer roller pair 56 as the belt 51 rotates. The secondary transfer roller pair 56 transfers the multi-color toner image onto the printing medium P. The secondary transfer roller pair 56 is an example of a transferring member which transfers a developing agent image from the image carrier onto a printing medium. The fixing unit 7 fixes, to the printing medium P by pressure and temperature, the toner image transferred on the printing medium P.

Figure 2:
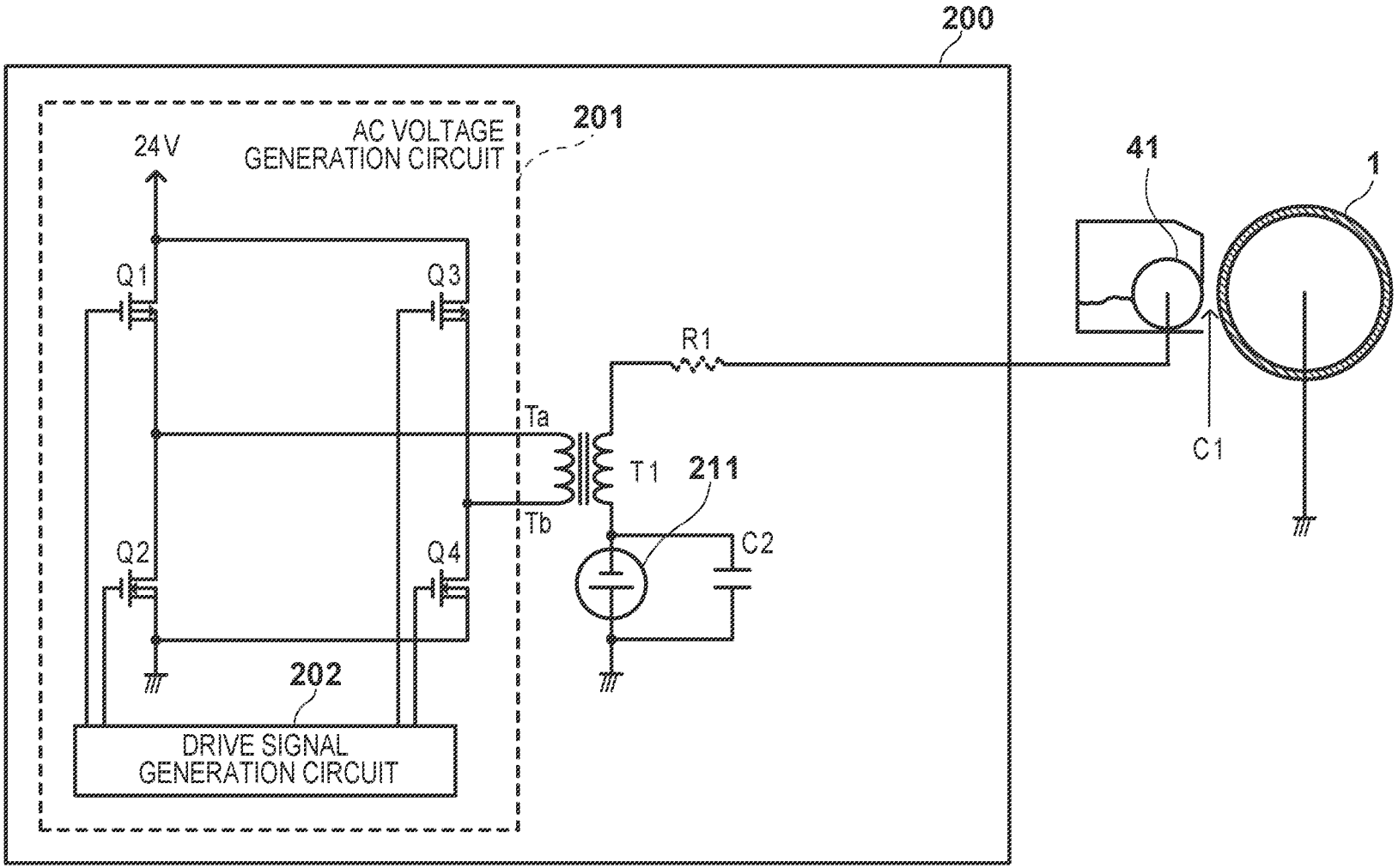
FIG. 2 is a circuit diagram showing a power supply device according to the first embodiment.

FIG. 2 shows the power supply device 200 which generates a developing bias, the developing unit 4, and the photosensitive member 1. The power supply device 200 includes an AC voltage generation circuit 201, a transformer T1, and a DC voltage source 211 which generates a DC voltage. A damping resistor R1 is generally inserted in series between the transformer T1 and the developing sleeve, but may be basically omitted in the present invention. A capacitance C1 is that formed at the gap between the developing sleeve 41 and the photosensitive member 1. The DC voltage source 211 superposes a DC voltage on an AC voltage to be output to the secondary side of the transformer T1 of the AC voltage generation circuit 201. A developing bias of a rectangular wave formed by superposing the AC and DC voltages is applied to the developing sleeve 41. Note that a capacitor C2 is parallel-connected to the DC voltage source 211.

The AC voltage generation circuit 201 functions as an AC voltage generation unit which outputs a blank pulse waveform having a pulse period during which a rectangular wave is output and an idle period (blank period) during which no rectangular wave is output. The AC voltage generation circuit 201 and transformer T1 generate and output an AC voltage (rectangular wave) to be superposed on a DC voltage. The AC voltage generation circuit 201 includes a full bridge circuit made up of four semiconductor switching elements Q1, Q2, Q3, and Q4. The semiconductor switching elements Q1, Q2, Q3, and Q4 correspond to the first, second, third, and fourth switching units, respectively. The semiconductor switching element Q1 has one end coupled to a +24 V voltage source, and the other end coupled to a primary-side (primary winding-side) first terminal Ta of the transformer T1 and one end of the semiconductor switching element Q2. The other end of the semiconductor switching element Q2 is coupled to ground (that is, grounded). The semiconductor switching element Q3 has one end coupled to the +24 V voltage source, and the other end coupled to a primary-side second terminal Tb of the transformer T1 and one end of the semiconductor switching element Q4. The other end of the semiconductor switching element Q4 is coupled to ground. The transformer T1 is an example of a transforming unit which has the primary-side first terminal Ta coupled to the other end of the first switching unit and one end of the second switching unit, and the primary-side second terminal Tb coupled to the other end of the third switching unit and one end of the fourth switching unit, and receives a blank pulse waveform generated by the AC voltage generation unit.

A drive signal generation circuit 202 outputs gate signals to the gates (driving terminals) of the respective semiconductor switching elements to turn on Q1, off Q2, off Q3, and on Q4. As a result, a voltage is applied so that the potential at the first terminal Ta of the transformer winding becomes higher than that at Tb, generating a voltage with a positive amplitude in the secondary winding. Similarly, in accordance with an output instruction, the drive signal generation circuit 202 outputs gate signals to turn off Q1, on Q2, on Q3, and off Q4. Then, a voltage is applied between Ta and Tb so that the potential at the second terminal Tb of the transformer winding becomes higher than that at Ta, generating a voltage with a negative amplitude in the secondary winding.

Figure 3:
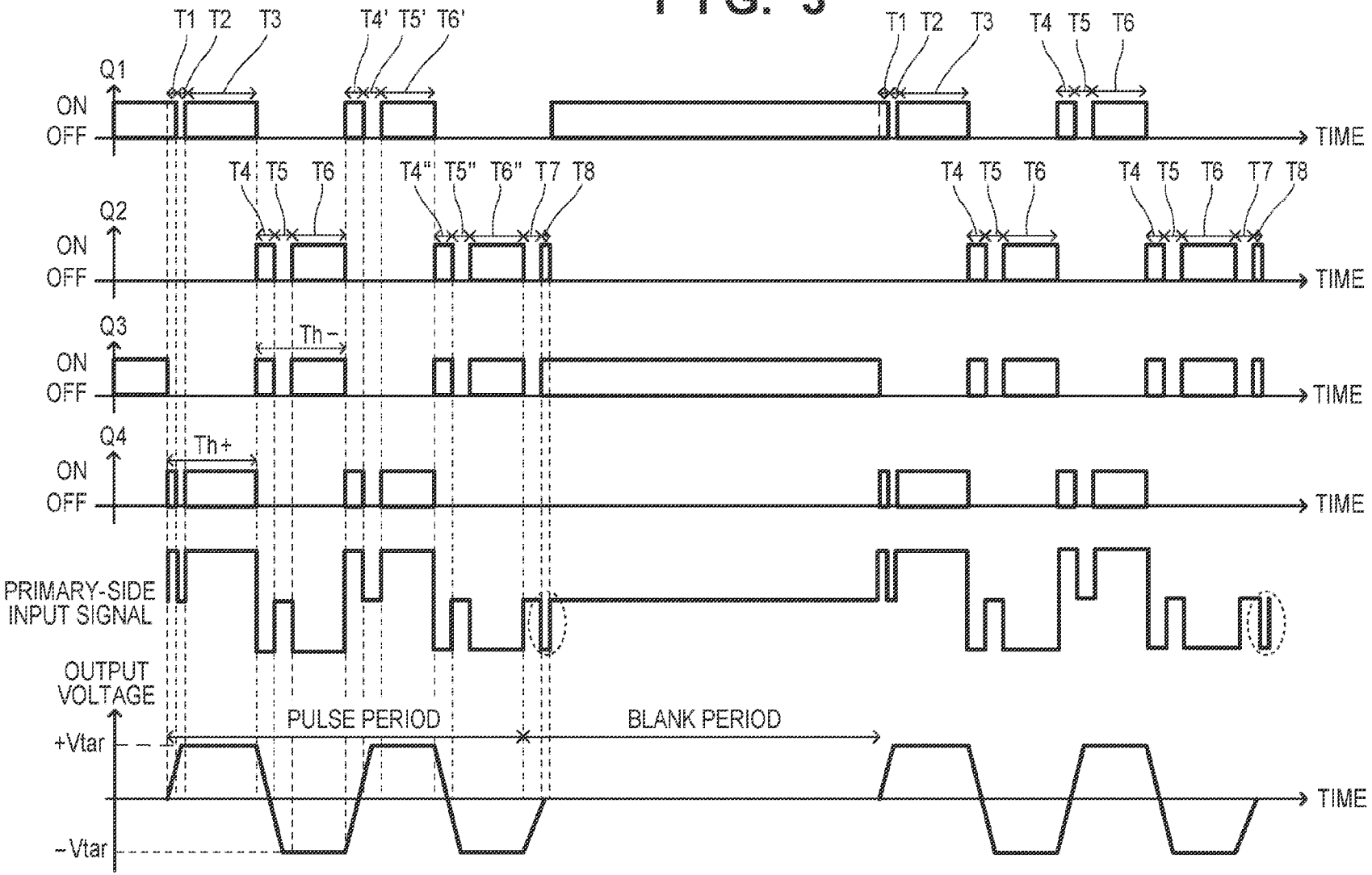
FIG. 3 is a waveform chart showing gate signals to semiconductor switching elements Q1, Q2, Q3, and Q4 and an output voltage waveform when generating a blank pulse waveform according to the first embodiment.

FIG. 3 shows gate signals to the semiconductor switching elements Q1, Q2, Q3, and Q4, a signal input to the primary side of the transformer T1, and an output voltage waveform when generating a blank pulse waveform. The blank pulse waveform has two pulses (rectangular wave) in the pulse period and two blanks in the blank period. Upon receiving a blank pulse output instruction from the host CPU to start image formation, the drive signal generation circuit 202 outputs drive signals (gate signals) to drive the semiconductor switching elements Q1, Q2, Q3, and Q4. The half cycle of the gate signal is formed from a driving pattern having the first ON period, OFF period, and second ON period. The ratio of the first ON period, OFF period, and second ON period is adjusted appropriately to reduce the distortion at the start of outputting a blank pulse waveform and a distortion at the end of the output. Particularly, the resonant waveform can be reduced by adjusting the length of the OFF period.

Referring to FIG. 3, a gate signal output to the gates of Q1 and Q4 in the periods T1 to T3 will be called the first drive signal. A gate signal output to the gates of Q2 and Q3 in the periods T4 to T6 will be called the second drive signal. Further, a gate signal output to the gates of Q2 and Q3 in the periods T7 and T8 will be called the third drive signal. More specifically, the first drive signal has the first ON period T1 during which both Q1 and Q4 are turned on, the OFF period T2 during which both Q1 and Q4 are turned off, and the second ON period T3 during which both Q1 and Q4 are turned on. The second drive signal has the first ON period T4 during which both Q2 and Q3 are turned on, the OFF period T5 during which both Q2 and Q3 are turned off, and the second ON period T6 during which both Q2 and Q3 are turned on. The third drive signal has the OFF period T7 during which both Q2 and Q3 are turned off, and the ON period T8 during which both Q2 and Q3 are turned on.

Referring to FIG. 3, the drive signal generation circuit 202 enables gate signals to Q1 and Q4 in the period T1 serving as the first ON period. Then, the transformer T1 starts outputting a positive output voltage. In the period T2 serving as the OFF period, the drive signal generation circuit 202 disables the gate signals to Q1 and Q4 to suppress the resonant waveform. In the period T3 serving as the second ON period, the drive signal generation circuit 202 enables the gate signals to Q1 and Q4. In this way, the output voltage becomes a rectangular wave which rises from 0 V to a positive target value Vtar+ in the periods T1 to T3. Note that the sum of the periods T1 to T3 corresponds to the half cycle of the rectangular wave. This half cycle will be called Th+. The drive signal generation circuit 202 functions as a drive signal generation unit which outputs the first drive signal to the first and fourth switching units out of the four switching units to cause the AC voltage generation unit to output a rectangular wave of the first half cycle in the blank pulse waveform.

In the period T4 serving as the first ON period, the drive signal generation circuit 202 enables gate signals to Q2 and Q3. Then, the transformer T1 starts outputting a negative output voltage. In the period T5 serving as the OFF period, the drive signal generation circuit 202 disables the gate signals to Q2 and Q3 to suppress the resonant waveform. In the period T6 serving as the second ON period, the drive signal generation circuit 202 enables the gate signals to Q2 and Q3. Accordingly, the output voltage becomes a rectangular wave which falls from Vtar+ to a negative target value Vtar− in the periods T4 to T6. Note that even the sum of the periods T4 to T6 corresponds to the half cycle of the rectangular wave. This half cycle will be called Th−. In the first embodiment, the periods Th+ and Th− are equal to each other because the ratio of the absolute value of the positive target value Vtar+ and that of the negative target value Vtar− in the rectangular wave is 1:1. More specifically, the drive signal generation circuit 202 outputs the first and second drive signals so that the ratio of the duration Th+ of the first drive signal and the duration Th− of the second drive signal becomes equal to that of the maximum amplitude Vtar− of a half-wave output in correspondence with the second drive signal and the maximum amplitude Vtar+ of a half-wave output in correspondence with the first drive signal.

The first ON period, OFF period, and second ON period of the respective half-waves (half cycles) always satisfy T1≠T4, T2≠T5, and T3≠T6, and T1<T4. That is, the length of the first ON period T1 of the first drive signal differs from that of the first ON period T4 of the second drive signal. The length of the OFF period T2 of the first drive signal differs from that of the OFF period T5 of the second drive signal. The length of the second ON period T3 of the first drive signal differs from that of the second ON period T6 of the second drive signal. Further, the first ON period T4 of the second drive signal is longer than the first ON period T1 of the first drive signal. These conditions aim at reducing a distortion at the start of outputting a blank pulse waveform. In this fashion, the drive signal generation circuit 202 functions as a drive signal generation unit which outputs the second drive signal to the second and third switching units out of the four switching units to cause the AC voltage generation unit to output a rectangular wave of the second half cycle in the blank pulse waveform.

In the period T4' serving as the first ON period, the drive signal generation circuit 202 enables the gate signals to Q1 and Q4. Then, the transformer T1 starts outputting a positive output voltage. In the period T5' serving as the OFF period, the drive signal generation circuit 202 disables the gate signals to Q1 and Q4 to suppress the resonant waveform. In the period T6' serving as the second ON period, the drive signal generation circuit 202 turns on Q1 and Q4. As a result, a rectangular wave which changes from the negative target voltage Vtar− to the positive target value Vtar+ in the periods T4' to T6' is obtained. In this case, T4=T4', T5=T5', and T6=T6' suffice. This is partly because the potential difference between an initial value (0) and the negative target value Vtar− and that between the initial value and the target value Vtar+ have peak-to-peak symmetry. Also, a voltage applied across the primary side of the transformer T1 has peak-to-peak symmetry between a case in which Q1 and Q4 of the AC voltage generation circuit 201 are ON and a case in which Q2 and Q3 are ON.

In the period T4", the drive signal generation circuit 202 enables the gate signals to Q2 and Q3. Then, the transformer T1 starts outputting a negative output voltage. In the period T5", the drive signal generation circuit 202 disables the gate signals to Q2 and Q3 to suppress the resonant waveform. In the period T6", the drive signal generation circuit 202 enables the gate signals to Q2 and Q3. Then, a rectangular wave which changes from the positive target value Vtar+ to the negative target value Vtar− in the periods T4" to T6" is obtained. The initial value in this period is Vtar+, which is different only in sign from the target value Vtar− in this period. Hence, T4=T4", T5=T5", and T6=T6".

In the period T7, the drive signal generation circuit 202 disables all the gate signals to be supplied to Q1, Q2, Q3, and Q4 to transit from the pulse period to the blank period. In the period T8, the drive signal generation circuit 202 enables the gate signals to be supplied to Q2 and Q3 to suppress the resonant waveform. After that, the drive signal generation circuit 202 disables the gate signal to Q2. By controlling the gate signals in this manner, the output voltage transits from Vtar− to the target control value of 0 V in the periods T7 and T8. Thus, the drive signal generation circuit 202 functions as a drive signal generation unit which outputs the third drive signal to the second and third switching units to transit the blank pulse waveform from the pulse period to the blank period.

Note that the operation in the period T7 during which all the gate signals to be supplied to Q1, Q2, Q3, and Q4 are disabled is different from those in the periods T1 and T4 during which a voltage is applied to the primary terminal of the transformer T1. This is because the former operation is an operation of transiting to the blank period while the latter operation is an operation of generating a rectangular wave. Thus, T7≠T1≠T4, and T8≠T2≠T5. That is, the length of the first ON period T1 of the first drive signal, that of the first ON period T4 of the second drive signal, and that of the OFF period T7 of the third drive signal are different from each other. Further, the length of the OFF period T2 of the first drive signal, that of the OFF period T5 of the second drive signal, and that of the ON period T8 of the third drive signal are different from each other. These conditions aim at reducing the distortion which may occur when transiting from the pulse period to the blank period.

The use of the above driving sequence can provide a rectangular wave of two pulses in which a resonant distortion is suppressed. Thereafter, the drive signal generation circuit 202 ensures a period of a desired length during which Q1 and Q3 are turned on and Q2 and Q4 are turned off. This length is large enough to achieve a blank period (including the periods T7 and T8) determined at the design stage of the image forming apparatus. A waveform whose one cycle is defined by the start of the period T1 and the end of the blank period serves as a blank pulse waveform of two pulses and two blanks.

According to the first embodiment, the period T1 and period T4 (T4' and T4") each serving as the first ON period have different lengths, and the periods T2 and period T5 (T5' and T5") each serving as the OFF period have different lengths. In addition, the periods T7 and T8 during which output of the rectangular wave ends are added to the gate signal driving pattern. As is apparent from FIG. 3, an additional pulse is added to a portion circled by a broken line in the primary-side input signal of the transformer T1. A desired blank pulse waveform can be output without depending on a damping resistor. Stable development can be achieved by supplying a developing bias to the developing sleeve 41 from the power supply device 200 which reduces the distortion of the blank pulse waveform.

Figure 4:
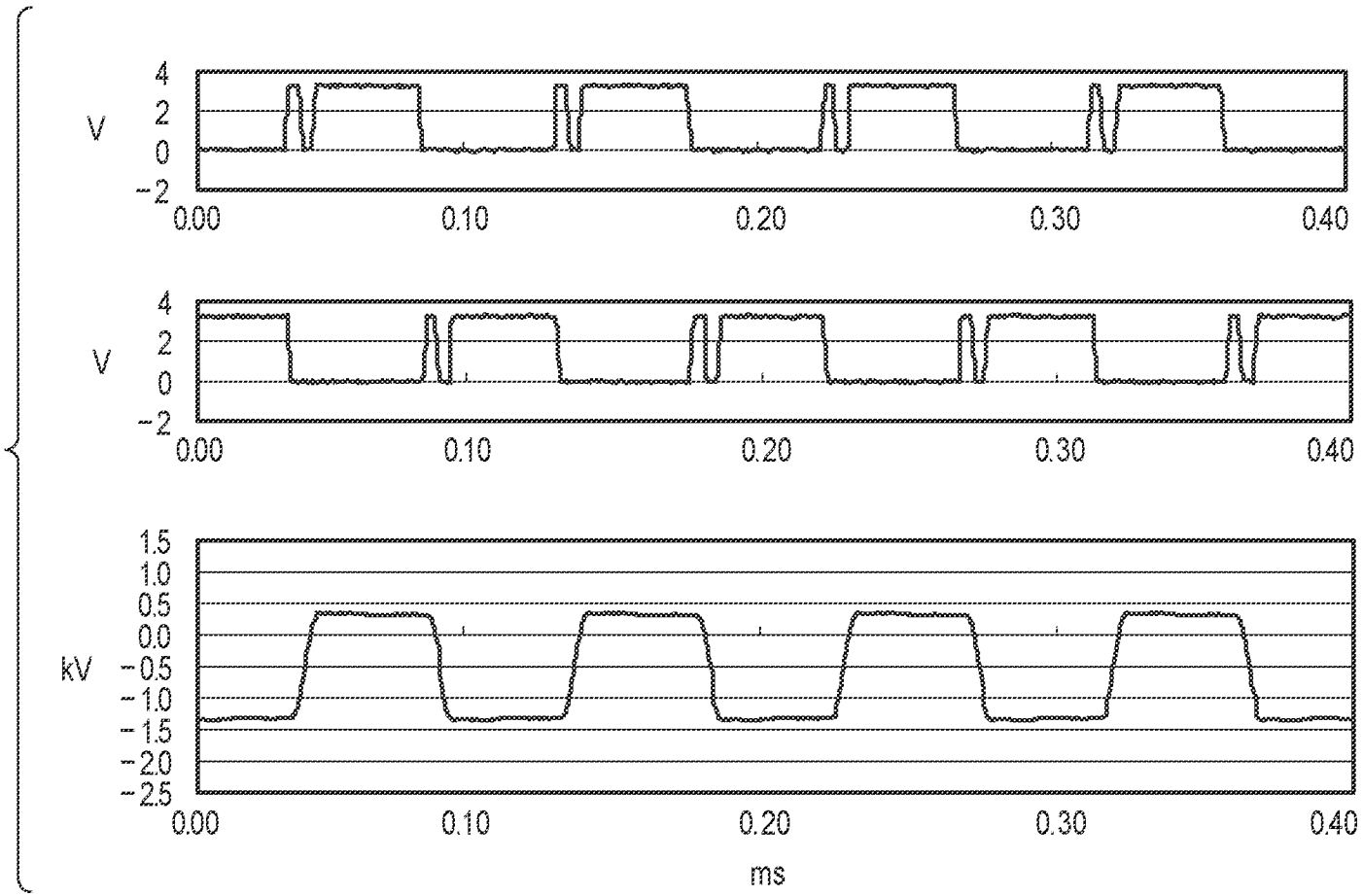
FIG. 4 is a waveform chart showing the measured waveform of a voltage output from a power supply device 200 to which the first embodiment is applied.

FIG. 4 is a waveform chart showing the measured waveform of a voltage output from the power supply device 200 to which the first embodiment is applied. The target value Vtar+ is 875 V, and the DC voltage is −500 V. FIG. 4 shows, sequentially from the top, a gate signal output to the gate of Q4, a gate signal output to the gate of Q2, and an output voltage waveform applied to the developing sleeve 41.

Figure 8:
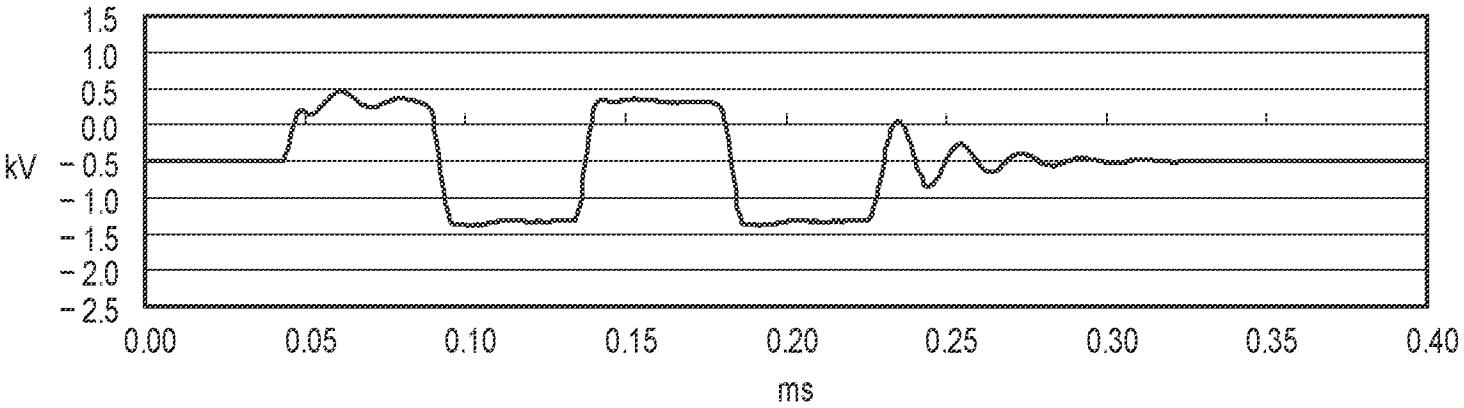
FIG. 8 is a waveform chart for explaining a distortion generated in a blank pulse waveform.

As is apparent from FIG. 4, the ratio of the first ON period, OFF period, and second ON period of a half-wave gate signal output first in the pulse period differs from that of the first ON period, OFF period, and second ON period of a gate signal output later. Also referring to FIG. 4, the periods T7 and T8 for suppressing the resonant waveform are adopted when transiting from the pulse period to the blank period. A comparison between FIGS. 4 and 8 reveals that distortions at the start of the pulse period and that of the blank period are suppressed satisfactorily.

As described above, the embodiment can basically omit the damping resistor R1. However, the damping resistor R1 may be employed for another reason, for example, to adjust the response speed of the blank pulse waveform. The damping resistor R1 may also be used in a case in which no resonant waveform can be fully suppressed by only adjusting the length of each period. Even in this case, a small resistor can be adopted as the damping resistor R1, which is superior to the conventional technique.

In FIG. 4, a waveform of two pulses and two blanks has been explained. For three or more pulses, it suffices to repeat the periods T4, T5, T6, T4', T5', and T6' by the number of pulses. This is because the embodiment has a feature in which the ratio of the periods T1 to T3 is different from that of the periods T4, T5, and T6, and the periods T7 and T8 are added.

Second Embodiment

Figure 5:
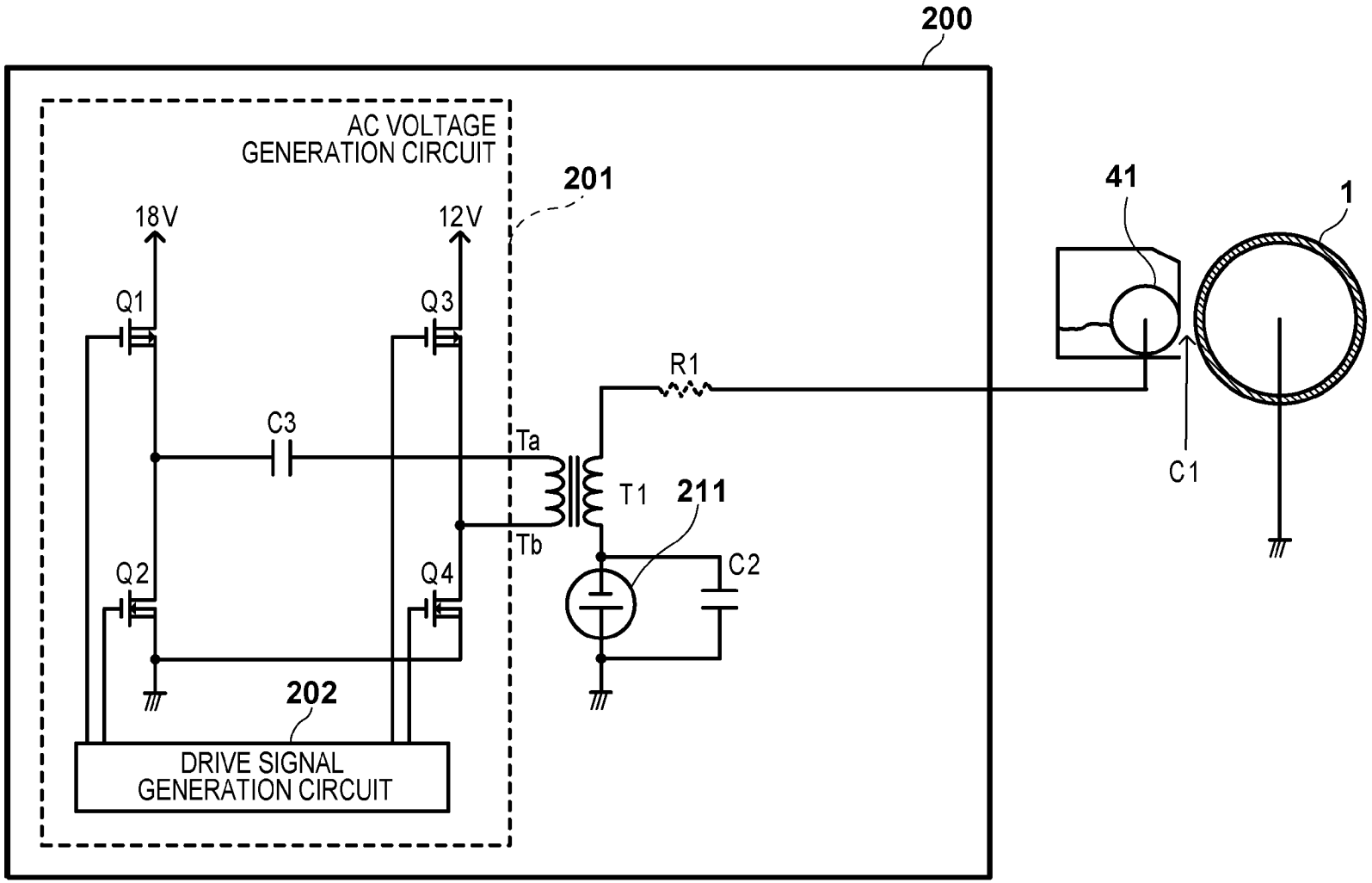
FIG. 5 is a schematic view showing a power supply device, a developing unit 4, and a photosensitive member 1 according to the second embodiment.

FIG. 5 is a schematic view showing a power supply device, a developing unit 4, and a photosensitive member 1 according to the second embodiment. In FIG. 2, a single voltage of 24 V is supplied to both Q1 and Q3. In FIG. 5, 18 V is applied to the drain of Q1, 12 V is applied to the drain of Q3, and a capacitor C3 is series-connected to a transformer T1. The remaining arrangement in the second embodiment is the same as that in the first embodiment.

The capacitance value of the added capacitor C3 is set to a value large enough not to change the voltage across the capacitor C3 from a potential difference of 6 V between the two power supply voltages of 18 V and 12 V, in order to suppress a change of the voltage across the capacitor C3 caused by a switching operation by semiconductor switching elements Q1, Q2, Q3, and Q4.

Figure 6:
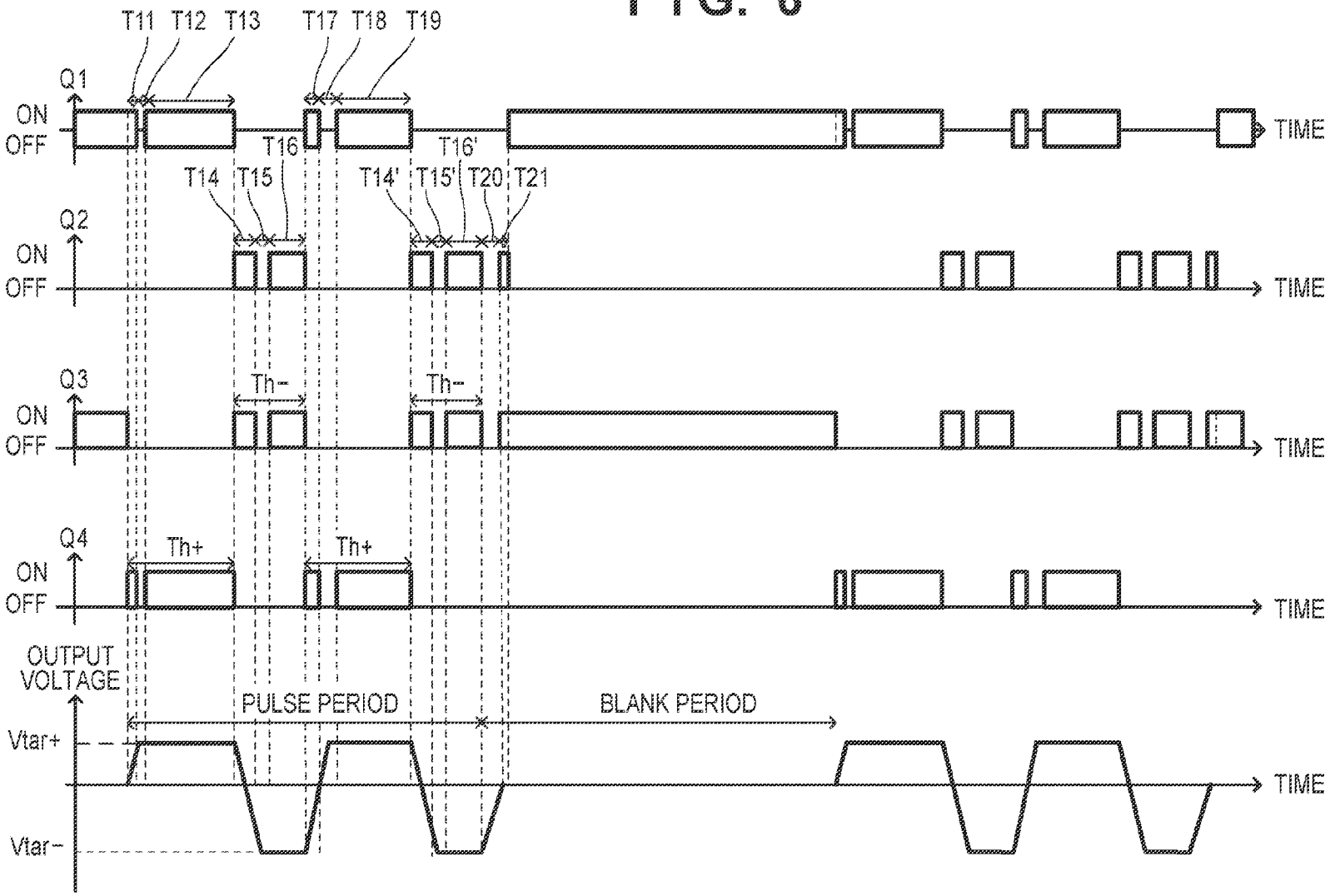
FIG. 6 is a waveform chart showing gate signals to semiconductor switching elements Q1, Q2, Q3, and Q4 and an output voltage waveform when generating a blank pulse waveform according to the second embodiment.

FIG. 6 is a waveform chart showing the pattern of a gate signal output from a drive signal generation circuit 202 and an output voltage waveform according to the second embodiment. The positive amplitude Vtar+ and negative amplitude Vtar− in the output voltage waveform according to the second embodiment have a ratio of 2:3. The half cycle Th+ serving as a positive amplitude period and the half cycle Th− serving as a negative amplitude period have a ratio of 3:2. The drive signal generation circuit 202 outputs the first and second drive signals so that the ratio of the duration Th+ of the first drive signal and the duration Th− of the second drive signal becomes equal to that of the maximum amplitude Vtar− of a half-wave output in correspondence with the second drive signal and the maximum amplitude Vtar+ of a half-wave output in correspondence with the first drive signal. A blank pulse waveform in which positive and negative amplitudes are asymmetrical can be employed to improve the developing performance of the image forming apparatus using a two-component developing agent. Especially, the negative amplitude is larger than the positive one. This strongly promotes movement of the negatively charged toner from the developing sleeve 41 to the photosensitive member 1, and restricts the movement of positive charge carriers to the photosensitive member 1.

In the period T11 serving as the first ON period shown in FIG. 6, the drive signal generation circuit 202 enables gate signals to Q1 and Q4. Then, output of an output voltage with a positive amplitude starts. In the period T12 serving as the OFF period, the drive signal generation circuit 202 disables the gate signals to Q1 and Q4 to suppress the resonant waveform. In the period T13 serving as the second ON period, the drive signal generation circuit 202 enables again the gate signals to Q1 and Q4. As a result, a rectangular wave with the positive target value Vtar+ is obtained in the periods T11 to T13 for generating the first rectangular wave after the power supply device 200 is activated.

In the period T14, the drive signal generation circuit 202 enables gate signals to Q2 and Q3. Then, output of an output voltage with a negative amplitude starts. In the period T15, the drive signal generation circuit 202 disables the gate signals to Q2 and Q3 to suppress the resonant waveform. In the period T16, the drive signal generation circuit 202 enables again the gate signals to Q2 and Q3. In the periods T14 to T16, the amplitude of the output voltage changes from Vtar+ to Vtar−. As described above, Th+:Th−=3:2. The first ON periods, OFF periods, and second ON periods of the respective half-waves have relations of T11≠T14, T12≠T15, and T13≠T16. This is because the potential difference between the initial and target values of the amplitude differs between the respective half-waves. That is, the periods T11 to T16 have lengths corresponding to respective potential differences.

In the period T17, the drive signal generation circuit 202 enables the gate signals to Q1 and Q4. In response to this, an output voltage with a positive amplitude is output. In the period T18, the drive signal generation circuit 202 disables the gate signals to Q1 and Q4 to suppress the resonant waveform. In the period T19, the drive signal generation circuit 202 enables the gate signals to Q1 and Q4. In the periods T17 to T19, a rectangular wave whose amplitude changes from Vtar− to Vtar+ is obtained. The potential difference from the initial value to target value of the amplitude in the periods T14 to T16 is equal to that in the periods T17 to T19 except for the sign. However, a voltage applied across the primary side of the transformer T1 differs between a case in which Q1 and Q4 are ON and a case in which Q2 and Q3 are ON. More specifically, the voltage across the transformer T1 in transition from the initial value Vtar+ to the target value Vtar− is −18 V, whereas the voltage in transition from the initial value Vtar− to the target value Vtar+ is 12 V. From this, conditions which should be satisfied by the first ON period, OFF period, and second ON period are T14≠T17, T15≠T18, and T16≠T19.

In the period T14', the drive signal generation circuit 202 enables the gate signals to Q2 and Q3. Then, output of an output voltage with a negative amplitude starts. In the period T15', the drive signal generation circuit 202 disables the gate signals to Q2 and Q3 to suppress the resonant waveform. In the period T16', the drive signal generation circuit 202 enables again the gate signals to Q2 and Q3. In the periods T14' to T16', a rectangular wave whose amplitude changes from Vtar+ to Vtar− is obtained. In the periods T14' to T16', conditions regarding the initial value Vtar+ and target value Vtar− are the same as those in the periods T14 to T16. Hence, T14=T14', T15=T15', and T16=T16'.

In the period T20, the drive signal generation circuit 202 disables all the gate signals to Q1, Q2, Q3, and Q4 to transit to the blank period. In the period T21, the drive signal generation circuit 202 enables the gate signals to Q2 and Q3 to suppress the resonant waveform. The operation in the period T20 during which all the gate signals to Q1, Q2, Q3, and Q4 are disabled is different from those in the periods T11 and T14 during which a voltage is applied to the transformer T1. Hence, T20≠T11≠T14, and T21≠T12≠T15 are established.

Finally, the drive signal generation circuit 202 enables the gate signals to Q1 and Q3, and disables those to Q2 and Q4. The amplitude of the output voltage then changes from Vtar− to 0 V.

By the above driving sequence, a rectangular wave of two pulses almost free from a resonant distortion can be obtained. Thereafter, the drive signal generation circuit 202 ensures a blank period by enabling the gate signals to Q1 and Q3 and disabling those to Q2 and Q4. The periods T20 and T21 are also part of the blank period.

Figure 7:
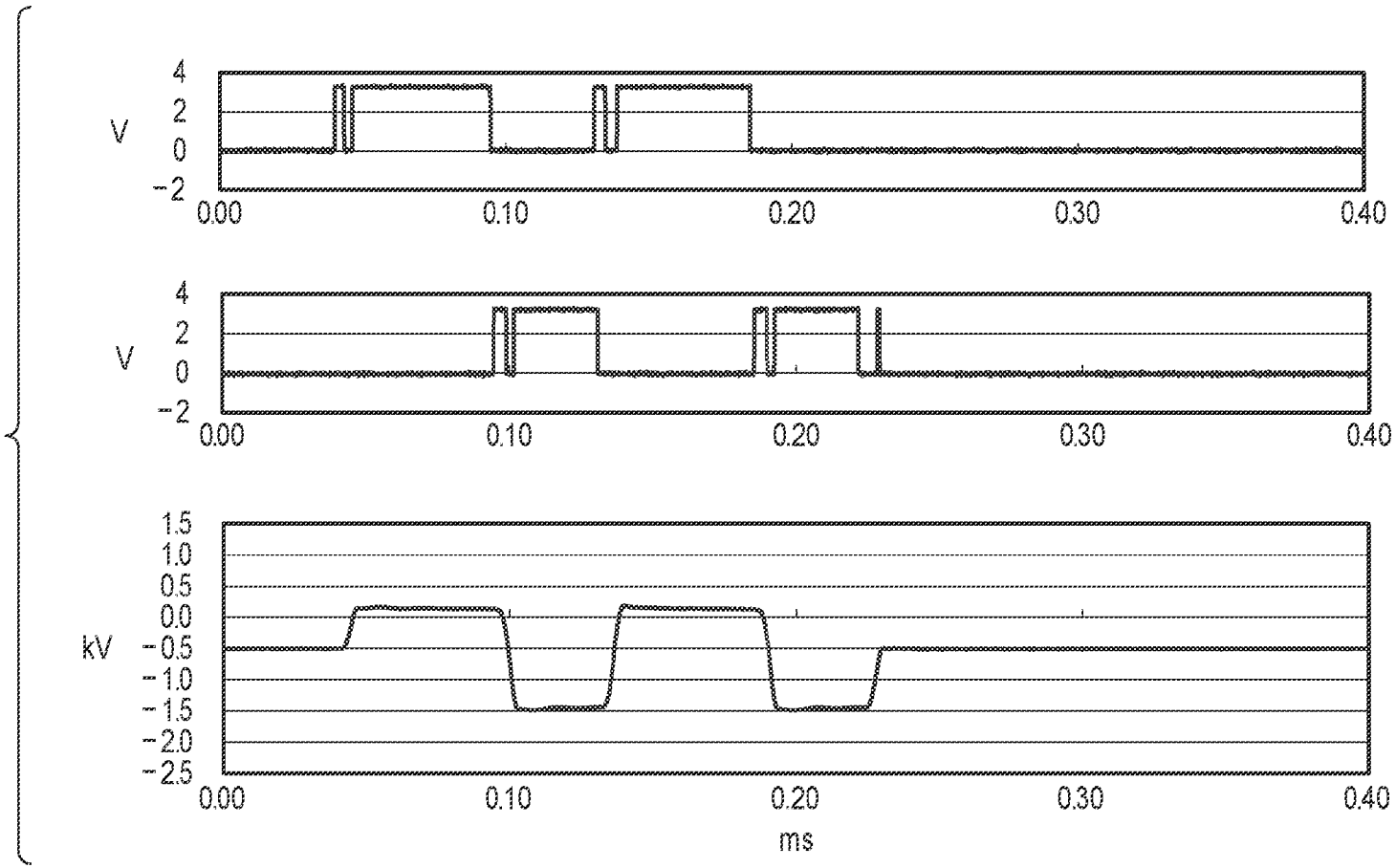
FIG. 7 is a waveform chart showing the measured waveform of a voltage output from a power supply device 200 to which the second embodiment is applied.

FIG. 7 is a waveform chart showing the measured waveform of a voltage output from the power supply device 200 to which the second embodiment is applied. FIG. 7 shows, sequentially from the top, a gate signal output to the gate of Q4, a gate signal output to the gate of Q2, and an output voltage waveform applied to the developing sleeve 41. As shown in FIG. 7, the second embodiment can obtain the same effects as those in the first embodiment by properly adjusting the lengths of the respective periods even when the magnitudes of the positive and negative amplitudes are different from each other in a rectangular wave which forms a blank pulse waveform.

The conditions imposed on the respective periods in the first and second embodiments have been explained. The practical lengths of the respective periods depend on conditions necessary for the developing bias. It suffices to determine the lengths of the respective periods by experiment or simulation to meet the above-described conditions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-212706, filed Sep. 22, 2010 which is hereby incorporated by reference herein in its entirety.

What is claimed is:

1. An image forming apparatus comprising:

a developing unit which develops a latent image formed on a photosensitive member with a developing agent;

a supply unit which supplies, to said developing unit, a developing alternating current bias voltage with a waveform having a pulse period during which a rectangular wave is output and a blank period during which no rectangular wave is output; and an input signal generation unit which generates, as an input signal to be supplied to a primary side of a transforming unit that forms the developing alternating current bias voltage, an input signal obtained by adding an additional pulse smaller in width than the rectangular wave in the pulse period at a timing to transit from the pulse period to the blank period, wherein said input signal generation unit sets an OFF period of a predetermined width near a start of each rectangular wave corresponding to the pulse period of the input signal.

2. The apparatus according to claim 1, wherein the width of the additional pulse added at the timing to transit from the pulse period to the blank period is smaller than the predetermined width of the OFF period of a final rectangular wave out of a plurality of rectangular waves in the pulse period.

3. A power supply circuit comprising:

an alternating current voltage generation unit which outputs a blank pulse waveform having a pulse period during which a rectangular wave is output and a blank period during which no rectangular wave is output, said alternating current voltage generation unit including a full bridge circuit formed from a first switching unit having one end coupled to a voltage source, a second switching unit having one end coupled to the other end of the first switching unit and the other end coupled to ground, a third switching unit having one end coupled to the voltage source, and a fourth switching unit having one end coupled to the other end of the third switching unit and the other end coupled to ground;

a transforming unit which receives the blank pulse waveform generated by said alternating current voltage generation unit, said transforming unit having a primary-side first terminal coupled to the other end of the first switching unit and the one end of the second switching unit, and a primary-side second terminal coupled to the other end of the third switching unit and the one end of the fourth switching unit; and a drive signal generation unit which outputs a first drive signal to driving terminals of the first switching unit and fourth switching unit to cause said alternating current voltage generation unit to output a rectangular wave of a first half cycle in the blank pulse waveform, and outputs a second drive signal to driving terminals of the second switching unit and third switching unit to cause said alternating current voltage generation unit to output a rectangular wave of a second half cycle in the blank pulse waveform, wherein the first drive signal has a first ON period during which both the first switching unit and the fourth switching unit are turned on, an OFF period during which both the first switching unit and the fourth switching unit are turned off, and a second ON period during which both the first switching unit and the fourth switching unit are turned on, the second drive signal has a first ON period during which both the second switching unit and the third switching unit are turned on, an OFF period during which both the second switching unit and the third switching unit are turned off, and a second ON period during which both the second switching unit and the third switching unit are turned on, and a length of the first ON period of the first drive signal and a length of the first ON period of the second drive signal are different from each other, a length of the OFF period of the first drive signal and a length of the OFF period of the second drive signal are different from each other, a length of the second ON period of the first drive signal and a length of the second ON period of the second drive signal are different from each other, and the length of the first ON period of the second drive signal is larger than the length of the first ON period of the first drive signal.

4. The circuit according to claim 3, wherein said drive signal generation unit outputs a third drive signal to the second switching unit and the third switching unit to transit the blank pulse waveform from the pulse period to the blank period, the third drive signal has an OFF period during which both the second switching unit and the third switching unit are turned off, and an ON period during which both the second switching unit and the third switching unit are turned on, and the length of the first ON period of the first drive signal, the length of the first ON period of the second drive signal, and a length of the OFF period of the third drive signal are different from each other, and the length of the OFF period of the first drive signal, the length of the OFF period of the second drive signal, and a length of the ON period of the third drive signal are different from each other.

5. The circuit according to claim 3, wherein said drive signal generation unit outputs the first drive signal and the second drive signal to make a ratio of a duration of the first drive signal and a duration of the second drive signal equal to a ratio of a maximum amplitude of a half-wave output in correspondence with the second drive signal and a maximum amplitude of a half-wave output in correspondence with the first drive signal.

6. A power supply circuit comprising:

an alternating current voltage generation unit which outputs a blank pulse waveform having a pulse period during which a rectangular wave is output and a blank period during which no rectangular wave is output, said alternating current voltage generation unit including a full bridge circuit formed from a first switching unit having one end coupled to a voltage source, a second switching unit having one end coupled to the other end of the first switching unit and the other end coupled to ground, a third switching unit having one end coupled to the voltage source, and a fourth switching unit having one end coupled to the other end of the third switching unit and the other end coupled to ground;

a transforming unit which receives the blank pulse waveform generated by said alternating current voltage generation unit, said transforming unit having a primary-side first terminal coupled to the other end of the first switching unit and the one end of the second switching unit, and a primary-side second terminal coupled to the other end of the third switching unit and the one end of the fourth switching unit; and a drive signal generation unit which outputs a first drive signal to driving terminals of the first switching unit and fourth switching unit to cause said alternating current voltage generation unit to output a rectangular wave of a first half cycle in the blank pulse waveform, outputs a second drive signal to driving terminals of the second switching unit and third switching unit to cause said alternating current voltage generation unit to output a rectangular wave of a second half cycle in the blank pulse waveform, and outputs a third drive signal to driving terminals of the second switching unit and third switching unit to transit the blank pulse waveform from the pulse period to the blank period, wherein the third drive signal has an OFF period during which both the second switching unit and the third switching unit are turned off, and an ON period during which both the second switching unit and the third switching unit are turned on, the first drive signal has a first ON period during which both the first switching unit and the fourth switching unit are turned on, and an OFF period during which both the first switching unit and the fourth switching unit are turned off, and the second drive signal has a first ON period during which both the second switching unit and the third switching unit are turned on, and an OFF period during which both the second switching unit and the third switching unit are turned off, and wherein a length of the first ON period of the first drive signal, a length of the first ON period of the second drive signal, and a length of the OFF period of the third drive signal are different from each other, and a length of the OFF period of the first drive signal, a length of the OFF period of the second drive signal, and a length of the ON period of the third drive signal are different from each other.

7. The circuit according to claim 6, wherein said drive signal generation unit outputs the first drive signal and the second drive signal to make a ratio of a duration of the first drive signal and a duration of the second drive signal equal to a ratio of a maximum amplitude of a half-wave output in correspondence with the second drive signal and a maximum amplitude of a half-wave output in correspondence with the first drive signal.

8. An image forming apparatus comprising:

a power supply circuit;

a developing member to which a blank pulse waveform supplied from said power supply circuit is applied;

an image carrier which bears an electrostatic latent image that is developed with a developing agent supplied from said developing member; and a transferring member which transfers a developing agent image from the image carrier onto a printing medium, said power supply circuit including:

an alternating current voltage generation unit which outputs a blank pulse waveform having a pulse period during which a rectangular wave is output and a blank period during which no rectangular wave is output, said alternating current voltage generation unit including a full bridge circuit formed from a first switching unit having one end coupled to a voltage source, a second switching unit having one end coupled to the other end of the first switching unit and the other end coupled to ground, a third switching unit having one end coupled to the voltage source, and a fourth switching unit having one end coupled to the other end of the third switching unit and the other end coupled to ground;

a transforming unit which receives the blank pulse waveform generated by said alternating current voltage generation unit, said transforming unit having a primary-side first terminal coupled to the other end of the first switching unit and the one end of the second switching unit, and a primary-side second terminal coupled to the other end of the third switching unit and the one end of the fourth switching unit; and a drive signal generation unit which outputs a first drive signal to driving terminals of the first switching unit and fourth switching unit to cause said alternating current voltage generation unit to output a rectangular wave of a first half cycle in the blank pulse waveform, and outputs a second drive signal to driving terminals of the second switching unit and third switching unit to cause said alternating current voltage generation unit to output a rectangular wave of a second half cycle in the blank pulse waveform, wherein the first drive signal has a first ON period during which both the first switching unit and the fourth switching unit are turned on, an OFF period during which both the first switching unit and the fourth switching unit are turned off, and a second ON period during which both the first switching unit and the fourth switching unit are turned on, the second drive signal has a first ON period during which both the second switching unit and the third switching unit are turned on, an OFF period during which both the second switching unit and the third switching unit are turned off, and a second ON period during which both the second switching unit and the third switching unit are turned on, and a length of the first ON period of the first drive signal and a length of the first ON period of the second drive signal are different from each other, a length of the OFF period of the first drive signal and a length of the OFF period of the second drive signal are different from each other, a length of the second ON period of the first drive signal and a length of the second ON period of the second drive signal are different from each other, and the length of the first ON period of the second drive signal is larger than the length of the first ON period of the first drive signal.

9. An image forming apparatus comprising:

a power supply circuit;

a developing member to which a blank pulse waveform supplied from said power supply circuit is applied;

an image carrier which bears an electrostatic latent image that is developed with a developing agent supplied from said developing member; and a transferring member which transfers a developing agent image from the image carrier onto a printing medium, said power supply circuit including:

an alternating current voltage generation unit which outputs a blank pulse waveform having a pulse period during which a rectangular wave is output and a blank period during which no rectangular wave is output, said alternating current voltage generation unit including a full bridge circuit formed from a first switching unit having one end coupled to a voltage source, a second switching unit having one end coupled to the other end of the first switching unit and the other end coupled to ground, a third switching unit having one end coupled to the voltage source, and a fourth switching unit having one end coupled to the other end of the third switching unit and the other end coupled to ground;

a transforming unit which receives the blank pulse waveform generated by said alternating current voltage generation unit, said transforming unit having a primary-side first terminal coupled to the other end of the first switching unit and the one end of the second switching unit, and a primary-side second terminal coupled to the other end of the third switching unit and the one end of the fourth switching unit; and a drive signal generation unit which outputs a first drive signal to driving terminals of the first switching unit and fourth switching unit to cause said alternating current voltage generation unit to output a rectangular wave of a first half cycle in the blank pulse waveform, outputs a second drive signal to driving terminals of the second switching unit and third switching unit to cause said alternating current voltage generation unit to output a rectangular wave of a second half cycle in the blank pulse waveform, and outputs a third drive signal to driving terminals of the second switching unit and third switching unit to transit the blank pulse waveform from the pulse period to the blank period, wherein the third drive signal has an OFF period during which both the second switching unit and the third switching unit are turned off, and an ON period during which both the second switching unit and the third switching unit are turned on, the first drive signal has a first ON period during which both the first switching unit and the fourth switching unit are turned on, and an OFF period during which both the first switching unit and the fourth switching unit are turned off, and the second drive signal has a first ON period during which both the second switching unit and the third switching unit are turned on, and an OFF period during which both the second switching unit and the third switching unit are turned off, and wherein a length of the first ON period of the first drive signal, a length of the first ON period of the second drive signal, and a length of the OFF period of the third drive signal are different from each other, and a length of the OFF period of the first drive signal, a length of the OFF period of the second drive signal, and a length of the ON period of the third drive signal are different from each other.

10. The circuit according to claim 3, wherein a first terminal of a primary side of the transforming unit is coupled to both the other end of the first switching unit and the one end of the second switching unit via a capacitor.

11. The circuit according to claim 6, wherein a first terminal of a primary side of the transforming unit is coupled to both the other end of the first switching unit and the one end of the second switching unit via a capacitor.

12. The circuit according to claim 8, wherein a first terminal of a primary side of the transforming unit is coupled to both the other end of the first switching unit and the one end of the second switching unit via a capacitor.

13. The circuit according to claim 9, wherein a first terminal of a primary side of the transforming unit is coupled to both the other end of the first switching unit and the one end of the second switching unit via a capacitor.

* * * * *